US009272721B2

(12) United States Patent
Bohme

(10) Patent No.: US 9,272,721 B2
(45) Date of Patent: Mar. 1, 2016

(54) USER CONFIGURABLE HORIZONTAL BRAKE FEATURE FOR RAILROAD CROSSING GATES

(71) Applicant: Siemens Industry, Inc., Alpharetta, GA (US)

(72) Inventor: Richard C. Bohme, Louisville, KY (US)

(73) Assignee: SIEMENS INDUSTRY, INC., Alpharetta, GA (US)

( * ) Notice: Subject to any disclaimer, the term of this patent is extended or adjusted under 35 U.S.C. 154(b) by 142 days.

(21) Appl. No.: 13/865,704

(22) Filed: Apr. 18, 2013

(65) Prior Publication Data

US 2014/0312178 A1 Oct. 23, 2014

(51) Int. Cl.
*B61L 29/28* (2006.01)
*B61L 29/10* (2006.01)

(52) U.S. Cl.
CPC ..... *B61L 29/10* (2013.01)

(58) Field of Classification Search
CPC ..... B61L 29/00; B61L 29/02; B61L 29/04; B61L 29/08; B61L 29/10; B61L 29/18; B61L 29/22
USPC ..... 246/111–114 R, 125, 126, 218–222, 246/473 R, 473.1
See application file for complete search history.

(56) References Cited

U.S. PATENT DOCUMENTS 1,382,534 A 6/1921 Oelenschlager et al.
1,503,444 A 7/1924 Hanks
1,536,360 A 5/1925 Stewart
1,710,537 A 4/1929 Guarnieri
1,823,596 A 9/1931 Ferguson
1,825,730 A 10/1931 Daniel
1,874,926 A 8/1932 Dilley et al.
1,879,919 A 9/1932 Butterworth et al.
1,888,058 A 11/1932 Vincent
1,899,496 A 2/1933 Day
1,941,017 A 12/1933 Monge et al.
1,948,512 A 2/1934 Daniel
1,997,199 A 4/1935 Pranger
2,295,419 A 9/1942 Miskelly
3,038,991 A 6/1962 Swanton
3,925,930 A 12/1975 Gail et al.
4,067,523 A 1/1978 Kenny et al.
4,090,685 A * 5/1978 Pappas ..... 246/125
4,219,969 A 9/1980 Reinitz et al.
4,303,231 A 12/1981 Reuschenbach et al.
4,531,325 A 7/1985 Phillips (Continued)

FOREIGN PATENT DOCUMENTS

EP 0572362 A1 12/1993
FR 2712905 A1 6/1995

OTHER PUBLICATIONS

"Railroad-Highway Grade Crossing Handbook—Revised Second Edition, Section 9: Special Issues", Aug. 2007 (37 pages), downloaded from: http://safety.fhwa.dot.gov/xings/com_roaduser/07010/sec09.htm.

(Continued)

*Primary Examiner* — R.J. McCarry, Jr.

(57) ABSTRACT

A user configurable horizontal brake feature for a railroad crossing gate. The braking feature will maintain lowered crossing gate arms in the horizontal position when a train is approaching and until it is the proper time to raise the gate arms (e.g., after the passing of the approaching train).

14 Claims, 5 Drawing Sheets

(56) References Cited

U.S. PATENT DOCUMENTS

| | | | | |
|---|---|---|---|---|
| 4,655,002 | A | 4/1987 | Everson | |
| 4,897,960 | A | 2/1990 | Barvinek et al. | |
| 4,934,097 | A | 6/1990 | Quante | |
| 4,934,203 | A | 6/1990 | Bailey et al. | |
| 4,989,835 | A | 2/1991 | Hirsh | |
| 5,165,324 | A | 11/1992 | Maruoka | |
| 5,351,440 | A | 10/1994 | Vincent | |
| 5,466,088 | A | 11/1995 | Nasatka | |
| 5,469,660 | A | 11/1995 | Tamenne | |
| 5,884,432 | A | 3/1999 | DeLillo | |
| 6,189,839 | B1 | 2/2001 | Lemieux | |
| 6,212,825 | B1 | 4/2001 | Hopkins, Jr. | |
| 6,267,332 | B1 | 7/2001 | Almblad | |
| 6,523,788 | B2 * | 2/2003 | Zander | 246/111 |
| 6,997,417 | B2 | 2/2006 | Zarkades | |
| 7,384,017 | B1 | 6/2008 | Burke et al. | |
| 7,533,494 | B2 * | 5/2009 | Burke | 49/49 |
| 7,814,706 | B2 | 10/2010 | Gamache | |
| 7,818,920 | B2 * | 10/2010 | Causey et al. | 49/49 |
| 8,066,230 | B2 * | 11/2011 | Honeck et al. | 246/125 |
| 2004/0118048 | A1 | 6/2004 | Ronald | |
| 2005/0060936 | A1 | 3/2005 | Burke | |
| 2005/0284987 | A1 * | 12/2005 | Kande et al. | 246/125 |
| 2007/0175717 | A1 | 8/2007 | Grabher | |
| 2007/0194506 | A1 | 8/2007 | Adoline | |
| 2011/0113690 | A1 | 5/2011 | Luetzow | |
| 2012/0137590 | A1 | 6/2012 | Sullivan | |

OTHER PUBLICATIONS

PCT International Search Report mailed Feb. 5, 2015 corresponding to PCT International Application No. PCT/US2014/034085 filed Apr. 15, 2014 (10 pages).

* cited by examiner

USER CONFIGURABLE HORIZONTAL BRAKE FEATURE FOR RAILROAD CROSSING GATES

FIELD OF THE INVENTION

Embodiments of the invention relate to railroad crossing gates and, more particularly, to horizontal brake features for a railroad crossing gate.

BACKGROUND

At many roadway railroad crossings, pedestrian paths and sidewalks also cross the railroad track. Crossing gates, which typically are raised by default and lowered when a train approaches and crosses an intersection of a road and railroad track (i.e., a crossing), may be provided for roadway and pedestrian safety. There may be a separate gate for the roadway and the pedestrian path. At some intersections, the roadway gate and the pedestrian gate are raised and lowered by the same gate mechanism. Typically, this means that the same internal gearing of the gate mechanism drives both gates. Therefore, if a pedestrian manually raises the pedestrian gate, the internal gearing of the gate mechanism raises the roadway gate as well. This can create an unsafe situation whereby the railroad crossing appears to be clear to motorists even though a train is approaching.

To avoid this problem, some crossings use separate gate mechanisms for the roadway and pedestrian gates. This option, however, is undesirable because it is more expensive than single mechanism installations. Furthermore, single mechanism installations are already in place at countless railroad crossings, and replacing them with two-mechanism systems could be cost prohibitive for many railroad operators.

Thus, there is a need and desire for a mechanism to prevent the improper raising of the crossing gates when a train is approaching the crossing.

SUMMARY

Embodiments disclosed herein provide a method of controlling a crossing gate. The method comprises determining if a first crossing gate arm is in a substantially horizontal position; and locking the first crossing gate arm in the substantially horizontal position if it is determined that the first crossing gate arm is in the substantially horizontal position.

Another embodiment disclosed herein provides a railroad crossing gate comprising a first crossing gate arm connected to a first crossing gate support arm; and a gate mechanism connected to the first crossing gate support arm and for raising and lowering the first crossing gate support arm and the first crossing gate arm. The gate mechanism comprises a controller adapted to determine if the first crossing gate arm is in a substantially horizontal position, and lock the first crossing gate arm in the substantially horizontal position if it is determined that the first crossing gate arm is in the substantially horizontal position.

Further areas of applicability of the present disclosure will become apparent from the detailed description, drawings and claims provided hereinafter. It should be understood that the detailed description, including disclosed embodiments and drawings, are merely exemplary in nature intended for purposes of illustration only and are not intended to limit the scope of the invention, its application or use. Thus, variations that do not depart from the gist of the invention are intended to be within the scope of the invention.

DETAILED DESCRIPTION

While the following embodiments are discussed in the context of railroad crossing gates, it will be understood that this is for example only, and the scope of this disclosure is not limited to the railroad field. Access control gates can be used in a wide variety of devices and fields. Furthermore, while the following embodiments may be presented for use with specific pedestrian crossing gate systems, these are also presented as examples to provide greater understanding of the disclosure to those of ordinary skill in the relevant arts. Moreover, it should also be appreciated that the disclosed principles are not limited to crossing gates having two gate arms and that the principles disclosed herein can be used in a crossing gate or any entrance gate having only one arm. It should also be appreciated that some method steps are delineated as separate steps for ease of understanding, and that any such steps should not be construed as necessarily distinct nor order dependent in their performance.

Figure 1:
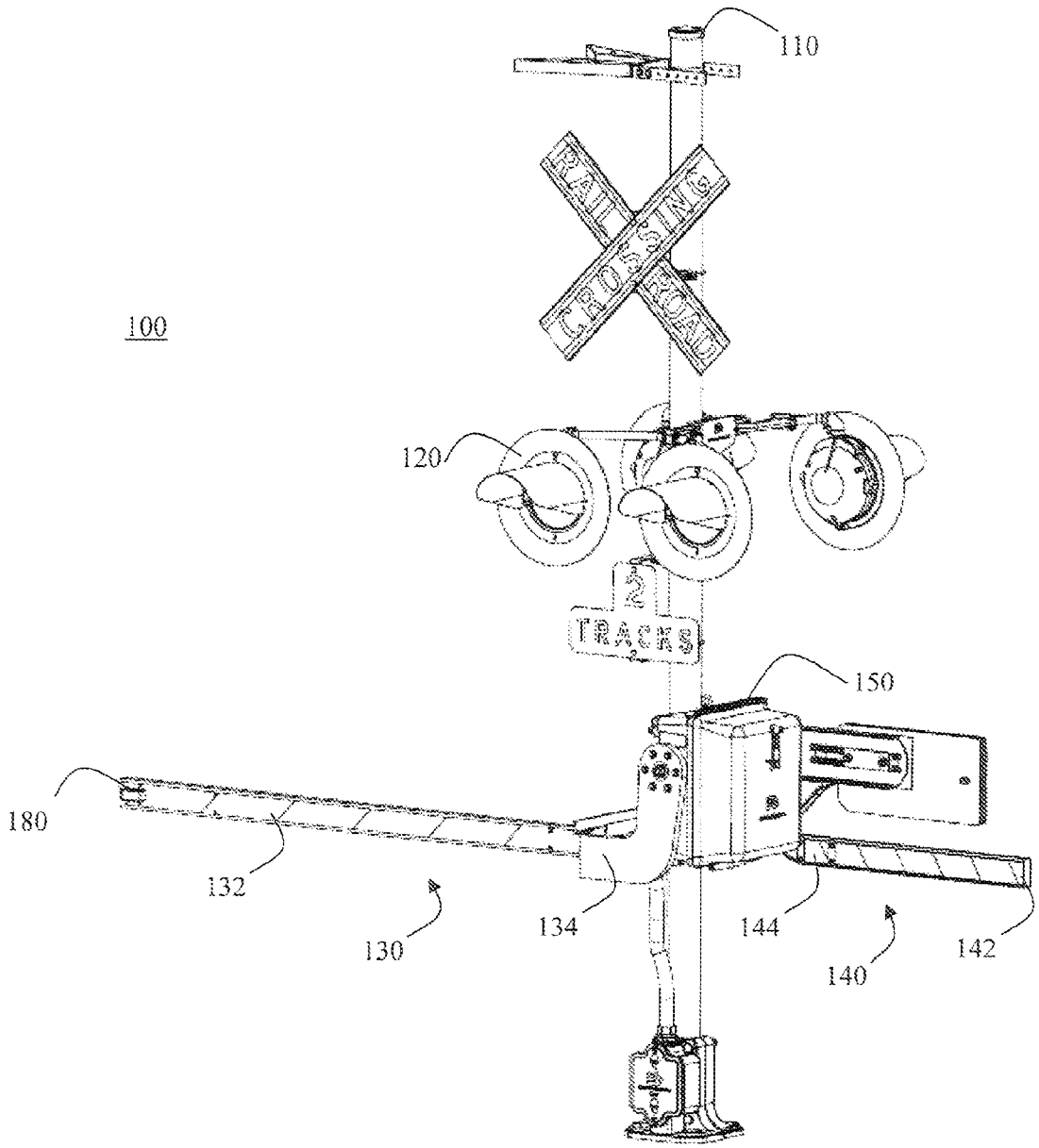
FIG. 1 illustrates a railroad crossing gate according to an embodiment of the invention.

FIG. 1 illustrates a railroad crossing gate 100 in a lowered or horizontal position. At many railroad crossings, at least one railroad crossing gate 100 may be placed on either side of the railroad track to restrict roadway traffic in both directions. At some crossings, pedestrian paths or sidewalks may run parallel to the roadway. To restrict road and sidewalk traffic, the illustrated railroad crossing gate 100 includes a separate roadway gate 130 and pedestrian gate 140. The roadway gate 130 and pedestrian gate 140 may be raised and lowered by the same gate mechanism 150.

The example railroad crossing gate 100 also includes a pole 110 and signal lights 120. The gate mechanism 150 is attached to the pole 110 and is used to raise and lower the roadway pedestrian gates 130, 140. The illustrated railroad crossing gate 100 is often referred to as a combined crossing gate. When a train approaches the crossing, the railroad crossing gate 100 may provide a visual warning using the signal lights 120. The gate mechanism 150 will lower the roadway gate 130 and the pedestrian gate 140 to respectively restrict traffic and pedestrians from crossing the track until the train has passed.

As shown in FIG. 1, the roadway gate 130 comprises a roadway gate support arm 134 that attaches a roadway gate arm 132 to the gate mechanism 150. Similarly, the pedestrian gate 140 comprises a pedestrian gate support arm 144 connecting a pedestrian gate arm 142 to the gate mechanism 150. When raised, the gates 130 and 140 are positioned so that they do not interfere with either roadway or pedestrian traffic. This position is often referred to as the vertical position. A "power-on" braking mechanism or other powered holding device (internal to the gate mechanism 150) is used to hold the gates 130, 140 when they are in the vertical position.

Figure 2:
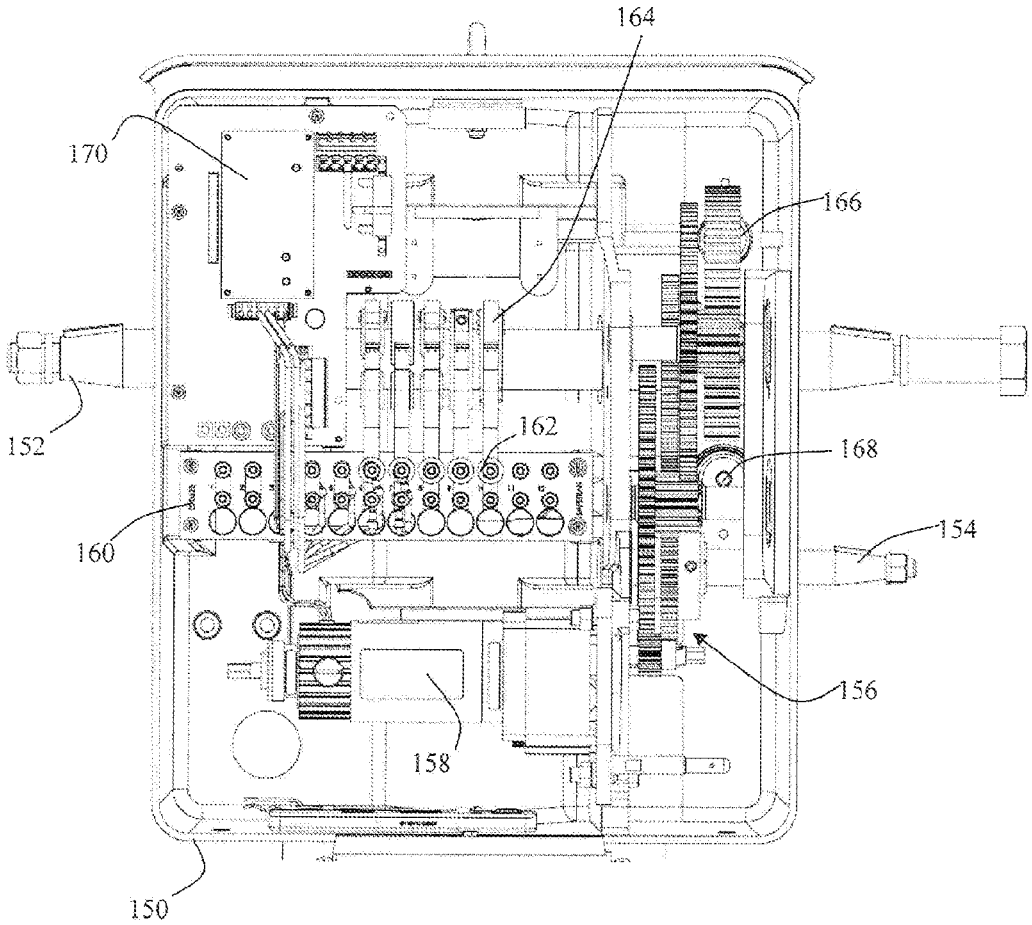
FIG. 2 illustrates a schematic drawing of the components of an example gate mechanism that can be used in the FIG. 1 railroad crossing gate.

Referring to FIGS. 1 and 2, typically, the gates 130, 140 are lowered from the vertical position using a motor contained within a motor/braking assembly 158 located inside of the gate mechanism 150. The motor drives gearing 156 that is connected to a main shaft 152 connected to the roadway gate support arm 134 and a second shaft 154 connected to the pedestrian gate support arm 144. The support arms 134, 144 are usually driven part of the way down by the motor (e.g., somewhere between 70 and 45 degrees) and then gravity and momentum are allowed to bring the arms 132, 142 and the support arms 134, 144 to the horizontal position. The gate mechanism 150 will include an adjustable spring buffer 166 that sets the final horizontal position for the support arms 134, 144 (and thus the gates 130, 140). It should be appreciated that the arms 132, 142 when lowered will not always be exactly parallel with the ground when in the "horizontal position." As such, the final "horizontal position" of the arms 132, 142 may include deviations from a true parallel relationship with the ground. The gate mechanism 150 will also include an adjustable spring buffer 168, but a dedicated cam 164 and contact 162 are used to set the final vertical position for the support arms 134, 144 (and thus the gates 130, 140). In the illustrated embodiment, the motor/braking assembly 158 contains the power-on braking mechanism, which is energized by a controller 170 to lock the support arms 134, 144 in the vertical position when the appropriate cam 164 (connected to the main shaft 152) closes the corresponding contact 162 on a terminal board 160. It should be appreciated that the arms 132, 142 when raised will not always be exactly perpendicular to the ground when in the "vertical position." As such, the final raised "vertical position" of the arms 132, 142 may include deviations from a true perpendicular relationship with the ground.

As mentioned above, if a pedestrian lifts up on the pedestrian arm 142, moving the pedestrian gate support arm 144 in the process, the roadway gate arm 132 (via the gearing 156 in the gate mechanism 150 and the roadway gate support arm 134) will also move up—this is undesirable and dangerous. Embodiments disclosed herein, however, will utilize the power-on braking mechanism (or other installed holding device) to maintain the support arms 134, 144, and thus the gates 130, 140, in the horizontal position until it is the proper time to raise the gates 130, 140 (i.e., after the passing of the approaching train). Hereinafter, the phrases "horizontal brake" and/or "horizontal brake feature" will be used to generally refer to the use of the braking/holding mechanism to maintain the roadway and pedestrian gates 130, 140 in the horizontal position in the manner described below.

In accordance with a first embodiment, a gate tip sensor 180 is mounted to the roadway gate arm 132 and electrically connected to the controller 170 within the gate mechanism 150. Often times, a gate tip sensor 180 is used as a diagnostic measure to ensure that the roadway and pedestrian gates 130, 140 are actually horizontal after they have been lowered. In accordance with the disclosed principles, however, feedback from the gate tip sensor 180 is used to energize the power-on braking/holding mechanism when the roadway and pedestrian gates 130, 140 are in the horizontal position. The energizing of the braking mechanism while the gates 130, 140 are in the horizontal position essentially locks the gates 130, 140 into this position and prevents a pedestrian from lifting the pedestrian arm 142 and improperly raising the roadway gate arm 132 when a train is approaching the crossing.

Figure 3:
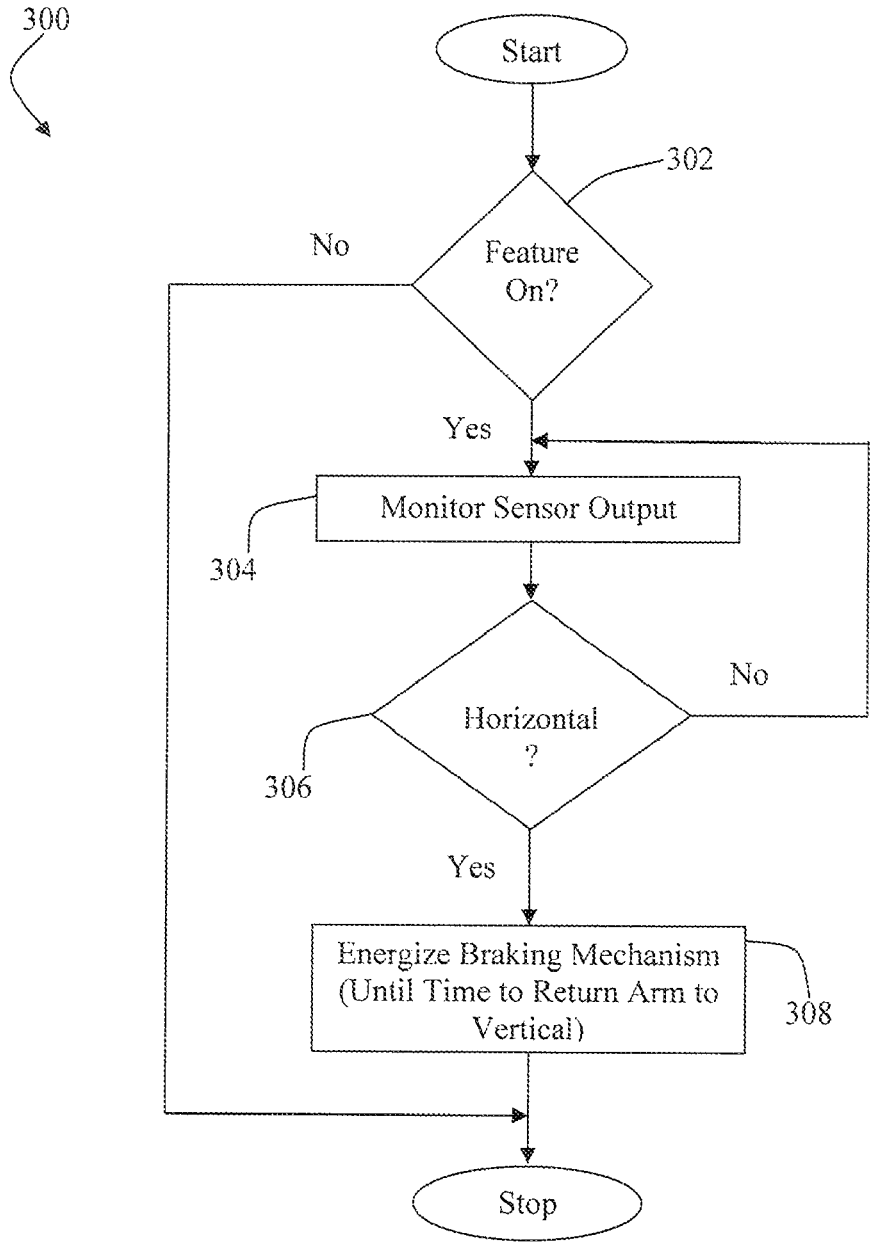
FIG. 3 is a flowchart illustrating the processing performed by a first embodiment disclosed herein.

FIG. 3 illustrates example processing 300 for implementing a horizontal brake in accordance with the first embodiment. In one embodiment, the processing 300 is performed when a train is approaching and after the motor within assembly 158 is turned off. At this point, the gates 130, 140 should be in the process of being lowered by momentum and/or gravity. in one embodiment, the process 300 provides a user option (such as a hardware or software switch 530 or other setting described below with reference to FIG. 5) to disable the horizontal brake feature if desired. The switch/setting 530 will output or have one value indicating that the horizontal brake feature is turned on and another output/value indicating that the horizontal brake feature is turned off. As such, the disclosed brake feature is user configurable.

The processing 300 begins by determining if the horizontal brake feature has been turned on at step 302. If it is determined that the horizontal brake feature is turned on, the process 300 continues at step 304 where the output of the gate tip sensor 180 is monitored. As is known, the gate tip sensor 180 will output one value when the sensor 180 is horizontal and another value when the sensor 180 is not horizontal. Since the sensor 180 is mounted to the roadway gate arm 132, the output of the sensor 180 will correspond to the position of the roadway gate arm 132 and the pedestrian gate arm 142.

The output of the sensor 180 is input by the controller 170 at step 304. At step 306, the controller 170 determines if the sensor's 180 output has the value indicating that the gate arms 132, 142 are horizontal. If it is determined that gate arms 132, 142 are horizontal, the controller 170 energizes or enables the braking mechanism (via an appropriate signal) within the motor/braking assembly 158 to maintain/lock the gate support arms 134, 144 and thus the gates 130, 140 in the horizontal position. With the braking mechanism activated, a pedestrian will not be able to lift the pedestrian gate arm 142, or the roadway gate arm 132 for that matter. In a desired embodiment, the braking mechanism remains energized until it is time to return the gates 130, 140 to the vertical position (e.g., after the train has passed the crossing). The process 300 terminates upon the completion of step 308 or after it is determined that the horizontal brake feature was turned off by the user (a "no" at step 302).

A second embodiment for implementing a horizontal brake feature does not require the gate tip sensor 180. Instead, components within the gate mechanism 150 can be used to determine when the gate support arms 134, 144 and thus the gate arms 132, 142 should be in the horizontal position. Referring again to FIG. 2, the terminal board 160 has contacts 162 that open and close in response to contact from corresponding cams 164. The cams 164 are connected to e.g., the main shaft 152. A cam 164 can be used to close a corresponding contact 162 when the gearing 156 connected to the shaft 152 is pressed against (i.e., stopped by) the horizontal buffer 166. When the contact 162 is closed, a signal indicating that the gates 130, 140 should be in the horizontal position is sent to the controller 170, which can then energize the braking/holding mechanism. In essence, the cam 164 and contact 162 form a horizontal position detector, whose output can be monitored and used to implement a horizontal brake in the manner described below.

Figure 4:
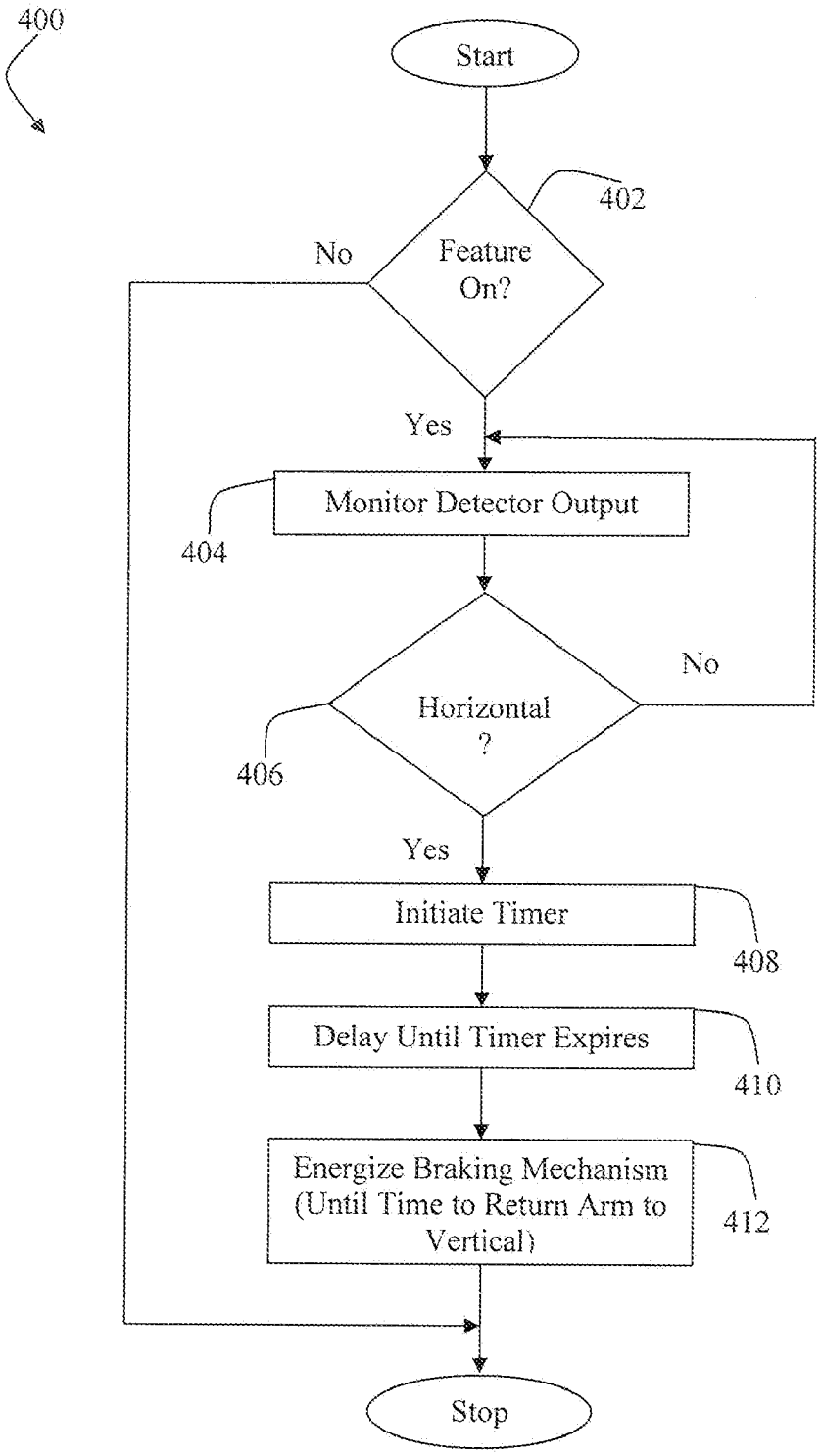
FIG. 4 is a flowchart illustrating the processing performed by a second embodiment disclosed herein.

FIG. 4 illustrates example processing 400 for implementing the horizontal brake feature in accordance with the second embodiment. As with the processing 300 illustrated in FIG. 3, the FIG. 4 processing 400 is performed when a train is approaching and after the motor within assembly 158 is turned off At this point. the gates 130, 140 should be in the process of being lowered by momentum and/or gravity. Similar to the processing 300 illustrated in FIG. 3, the FIG. 4 processing 400 also provides a switch/setting 530 allowing a user to disable the horizontal brake feature when desired. The switch/setting 530 will output or have one value indicating that the horizontal brake feature is turned on and another output/value indicating that the horizontal brake feature is turned off. As such, the disclosed horizontal brake feature of the second embodiment is also user configurable.

The processing 400 begins by determining if the horizontal brake feature has been turned on at step 402. If it is determined that the horizontal brake feature is turned on, the process 400 continues at step 404 where the output of the horizontal detector (e.g., contact 162, cam 164) is monitored. When the contact 162 is closed, meaning that the gates 130, 140 should be horizontal, a first value is sent to the controller 170. When the contact 162 is open, meaning that the gates 130, 140 should not be horizontal, a second value is sent to the controller 170.

The controller 170 monitors the output of the horizontal detector at step 404. At step 406, the controller 170 determines if the output has the value indicating that the gate arms 132, 142 should be horizontal. If it is determined that gate arms 132, 142 should be horizontal, the controller 170 initiates a timer at step 408 and waits for the timer to expire at step 410 before proceeding. Because the gates 130, 140 have a tendency to bounce after being lowered, it is desirable to wait for a predetermined amount of time to allow the gates 130, 140 to settle into the horizontal position before activating the braking mechanism. Once the predetermined amount of time has elapsed, the controller 170, at step 412, energizes/enables the braking mechanism within the motor/braking assembly 158 (via an appropriate signal) to lock the gate support arms 134, 144 and thus the gates 130, 140 in the horizontal position. With the braking mechanism activated, a pedestrian will not be able to lift the pedestrian gate arm 142, or the roadway gate arm 132 for that matter. In a desired embodiment, the braking mechanism remains energized until it is time to return the gates 130, 140 to the vertical position (e.g., after the train has passed the crossing). The process 400 terminates upon the completion of step 412 or after it is determined that the horizontal brake feature was turned off by the user (a "no" at step 402).

Figure 5:
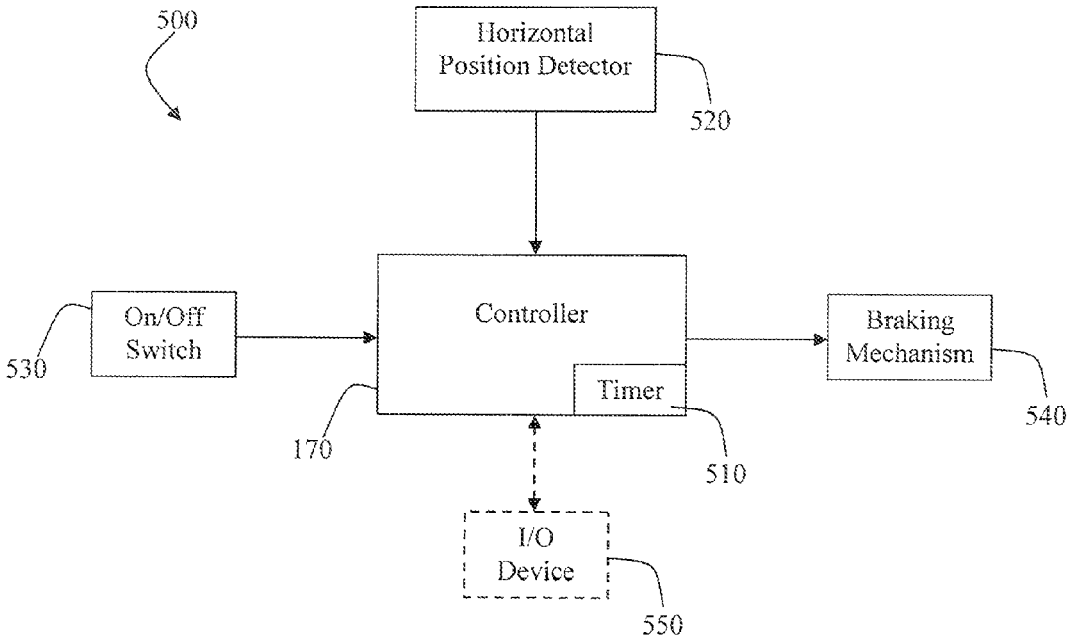
FIG. 5 is a block diagram of a horizontal braking control system constructed in accordance with an embodiment disclosed herein.

The processing 300, 400 described above maybe implemented as computer instructions and executed by the controller 170. The instructions can be stored in a non-volatile memory that is part of or connected to the controller 170. Referring to FIG. 5, it can be seen that the controller 170 is part of a horizontal brake control system 500. Depending upon the embodiment, some or all of the components within the system 500 can be located in the gate mechanism 150 (if desired). The controller 170 can be a processor or similar device capable of performing the processing 300, 400 described above. The controller 170 will implement and control the timer 510 in any conventional fashion. The controller 170 will input a signal from an on/off switch 530, which is used to enable or disable the horizontal brake feature. As described above, the switch 530 may be a hardware or software switch that will output one value when the user has enabled the horizontal brake feature and a second different value when the user has disabled the horizontal brake feature.

The controller 170 will input signals from a horizontal position detector 520. In the first example embodiment, the detector 520 is the gate tip sensor 180. In the second example embodiment, the detector 520 comprises the components internal to the gate mechanism, such as a cam 164 and contact 162. When the gates 130, 140 are in the horizontal position, the detector 520 causes a first signal value to be output to the controller 170. When the gates 130, 140 are not in the horizontal position, the detector 520 causes a second signal value to be output to the controller 170. The controller 170 will be connected to control the braking mechanism 540 (e.g., the braking mechanism within the motor/braking assembly 158) in accordance with the disclosed principles. In an another example embodiment, the controller 170 could be connected to an input/output (I/O) device 550, such as a keyboard, display, or other user interface. The I/O device 550 could provide a means for updating or adjusting the timer 510, for example, or displaying the various signals used by the system 500. The I/O device 550 could also be used to change the setting of the switch 530.

As can be appreciated, the disclosed embodiments provide several benefits that are not achieved by today's crossing gates. The use of a horizontal brake increases safety by preventing the public from raising an entrance gate arm when it should not be raised. The use of the horizontal brake also satisfies regulations mandating the prevention of the manual opening of crossing gates. The embodiments disclosed herein can be retrofitted into existing crossing gates with only slight modifications and in an inexpensive manner. Moreover, by being user configurable, the feature can be turned off in situations in which it is not needed.

The foregoing examples are provided merely for the purpose of explanation and are in no way to be construed as limiting. While reference to various embodiments is made, the words used herein are words of description and illustration, rather than words of limitation. Further, although reference to particular means, materials, and embodiments are shown, there is no limitation to the particulars disclosed herein. Rather, the embodiments extend to all functionally equivalent structures, methods, and uses, such as are within the scope of the appended claims.

Additionally, the purpose of the Abstract is to enable the patent office and the public generally, and especially the scientists, engineers and practitioners in the art who are not familiar with patent or legal terms or phraseology, to determine quickly from a cursory inspection the nature of the technical disclosure of the application. The Abstract is not intended to be limiting as to the scope of the present inventions in any way.

What is claimed is:

1. A method of controlling a crossing gate comprising:

determining if a first crossing gate arm is in a substantially horizontal position; and locking the first crossing gate arm in the substantially horizontal position by activating a braking mechanism when it is determined that the first crossing gate arm is in the substantially horizontal position, the braking mechanism preventing the first crossing gate arm from being raised while the braking mechanism is activated, wherein the step of determining if the first crossing gate arm is in the substantially horizontal position comprises:

monitoring an output of a sensor connected to the first crossing gate arm; and determining if a value of the sensor output is indicative of the first crossing gate arm being in the substantially horizontal position, wherein the crossing gate further comprises a second crossing gate arm and said step of locking the first crossing gate arm in the substantially horizontal position simultaneously locks the second crossing gate arm in the substantially horizontal position.

2. The method of claim 1, wherein the braking mechanism is connected to a first crossing gate support arm connected to the first crossing gate arm.

3. The method of claim 1, wherein the sensor is a gate tip sensor.

4. A railroad crossing gate comprising:

a first crossing gate arm connected to a first crossing gate support arm; and a gate mechanism connected to the first crossing gate support arm and for raising and lowering the first crossing gate support arm and the first crossing gate arm, said gate mechanism comprising a braking mechanism connected to the first crossing gate support arm and a controller, said controller adapted to:

determine if the first crossing gate arm is in a substantially horizontal position, and lock the first crossing gate arm in the substantially horizontal position by activating the braking mechanism when it is determined that the first crossing gate arm is in the substantially horizontal position, the braking mechanism preventing the first crossing gate arm from being raised while the braking mechanism is activated, wherein said gate mechanism comprises a horizontal position detector connected between a shaft used to raise and lower the first crossing gate support arm and the controller, the controller being adapted to determine if the first crossing gate arm is in the substantially horizontal position by:

monitoring an output of the horizontal position detector; and determining if a value of the horizontal position detector output is indicative of the first crossing gate arm being in the substantially horizontal position, wherein the railroad crossing gate further comprises a second crossing gate arm supported by a second crossing gate support arm, the second crossing gate support arm being connected to the gate mechanism, wherein the controller is adapted to lock the first crossing gate arm and the second crossing gate arm simultaneously.

5. The railroad crossing gate of claim 4, wherein the horizontal position detector comprises:

a cam mechanism connected to the shaft; and an electrical contact connected to the controller, the contact being adapted to open and close when contacted by the cam mechanism.

6. The railroad crossing gate of claim 5, wherein the controller is adapted to monitor the output of the horizontal position detector by determining if the contact is open or closed.

7. The railroad crossing gate of claim 4, wherein the controller is further adapted to:

initiate a timer after determining that the value of the horizontal position detector output is indicative of the first crossing gate arm being in the substantially horizontal position; and wait for the timer to expire before locking the first crossing gate arm in the substantially horizontal position.

8. The railroad crossing gate of claim 4, further comprising a switching mechanism connected to the controller and being adapted to output a first value in a first position and a second value in a second position, said controller being further adapted to lock the first crossing gate arm in the substantially horizontal position if it is determined that the first crossing gate arm is in the substantially horizontal position and the switching mechanism output has the first value, but not the second value.

9. A control system for a crossing gate, said system comprising:

a horizontal position detector adapted to output a first value when a first crossing gate arm is in a horizontal position and a second value if the first crossing gate arm is not in the horizontal position;

a holding mechanism being activated to hold a first crossing gate support arm connected to the first crossing gate arm in a locked position upon receipt of a control signal, the holding mechanism preventing the first crossing gate arm from being raised while the holding mechanism is activated; and a controller adapted to monitor the output of the horizontal position detector and to send the control signal to the holding mechanism when the output has the first value, wherein the holding mechanism is activated to hold a second crossing gate arm connected to a second crossing gate arm in the locked position upon receipt of a control signal, wherein the controller is adapted to lock the first crossing gate arm and the second crossing gate arm simultaneously.

10. The system of claim 9, wherein the horizontal position detector comprises a gate tip sensor connected to the first crossing gate arm.

11. The system of claim 9, wherein the horizontal position detector comprises:

a cam mechanism connected to a shaft connected to the first crossing gate support arm; and an electrical contact electrically connected to the controller, the contact being adapted to open and close when contacted by the cam mechanism, the first value corresponding to the closed contact and the second value corresponding to the opened contact.

12. The system of claim 11, further comprising a timer, wherein the controller is adapted to initiate the timer and wait for the timer to expire before sending the control signal to the holding mechanism.

13. The system of claim 9, further comprising a switching mechanism outputting a first switch value when the holding of the first and second crossing gate arms is desired and a second switch value when the holding of the first and second crossing gate arms is not desired, and wherein the controller is adapted to send the control signal only if the switching mechanism outputs the first switch value and the horizontal position detector output comprises the first value.

14. The system of claim 9, further comprising at least one device connected to the controller and being adapted to output the horizontal detector output.

* * * * *